US006176272B1

(12) United States Patent
Wahhoud et al.

(10) Patent No.: US 6,176,272 B1
(45) Date of Patent: Jan. 23, 2001

(54) METHOD FOR MONITORING THE OPERATION OF AN ELECTROMAGNET IN A WEFT PREWINDER OF A WEAVING LOOM

(75) Inventors: Adnan Wahhoud, Lindau; Dieter Teufel, Langenargen, both of (DE)

(73) Assignee: Lindauer Dornier Gesellschaft mbH, Lindau (DE)

( * ) Notice: Under 35 U.S.C. 154(b), the term of this patent shall be extended for 0 days.

(21) Appl. No.: 09/324,243

(22) Filed: Jun. 2, 1999

(30) Foreign Application Priority Data

Jun. 2, 1998 (DE) ..... 198 24 613

(51) Int. Cl.[7] ..... D03D 47/36

(52) U.S. Cl. ..... 139/452; 139/435.5; 324/415; 324/423

(58) Field of Search ..... 139/452, 435.5; 340/644; 379/17; 73/119 A, 168; 324/418, 415, 423

(56) References Cited

U.S. PATENT DOCUMENTS

| | | | | |
|---|---|---|---|---|
| 4,020,877 | | 5/1977 | Spisiak et al. . | |
| 4,487,235 | | 12/1984 | Sugita et al. . | |
| 4,516,076 | * | 5/1985 | Pillari | 324/418 |
| 4,673,004 | | 6/1987 | Rosseel et al. . | |
| 4,932,246 | * | 6/1990 | Deutsch et al. | 73/119 A |
| 5,031,669 | | 7/1991 | Wahhoud et al. . | |
| 5,031,672 | | 7/1991 | Wahhoud et al. . | |
| 5,067,527 | | 11/1991 | de Jager . | |
| 5,548,210 | * | 8/1996 | Dittrich | 324/158.1 |
| 5,787,937 | | 8/1998 | Teufel . | |

FOREIGN PATENT DOCUMENTS

| | | |
|---|---|---|
| 0415875 | 3/1991 | (EP) . |
| 0494050 | 7/1992 | (EP) . |
| 0544730 | 6/1993 | (EP) . |
| 0554221 | 8/1993 | (EP) . |
| 4352848 | 12/1992 | (JP) . |
| 5-51692 | 8/1993 | (JP) . |

* cited by examiner

*Primary Examiner*—Andy Falik
(74) *Attorney, Agent, or Firm*—W. F. Fasse; W. G. Fasse

(57) ABSTRACT

An electromagnet exhibits in its energization curve (I=f(t)) a characteristic feature or indicator, for example, in the form of a dip (1', 2') in the energization current. This indicator is used to control the operation of the magnet, for example, to synchronize its operation with that of another magnet. In a loom the operation of a weft stop magnet positioned next to a weft prewinder may be synchronized with the operation of a solenoid driving a valve that supplies air to the main weft insertion nozzle and/or relay nozzles. A magnet may also be controlled with reference to rated operation values so that its actual operation value coincides with the rated value or values or at least is maintained within a permissible tolerance range of rated values. The control takes place in closed loop fashion, for example, through the main loom control.

29 Claims, 2 Drawing Sheets

FIG. 1
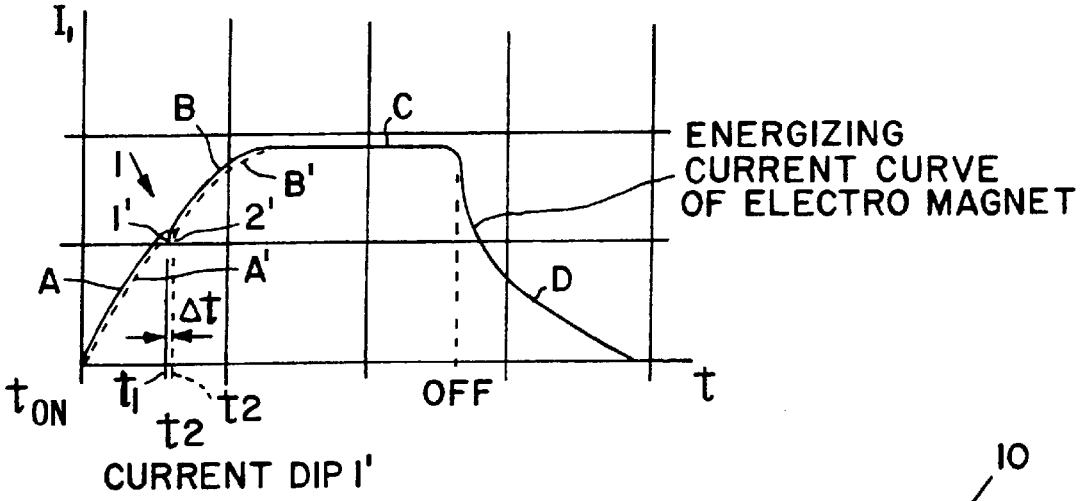
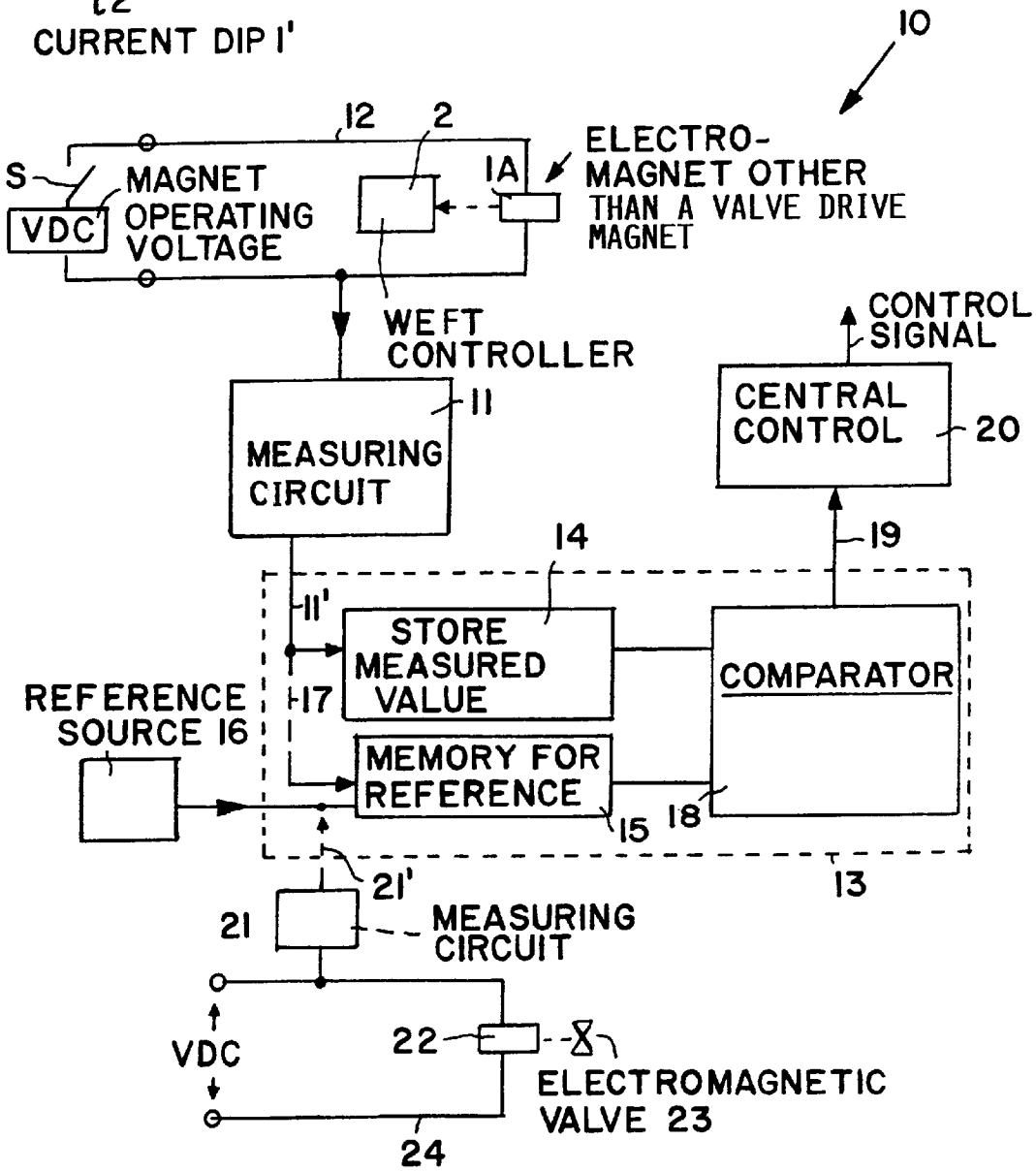
FIG. 2

METHOD FOR MONITORING THE OPERATION OF AN ELECTROMAGNET IN A WEFT PREWINDER OF A WEAVING LOOM

CROSS-REFERENCE TO RELATED U.S. PATENT

The present disclosure is related to the disclosure of U.S. Pat. No. 5,787,937 (Teufel), issued on Aug. 4, 1998, for "Method for Monitoring the Proper Functioning of Electromagnetic Air Valves in Pneumatic Looms". The entire disclosure of U.S. Pat. No. 5,787,937 is incorporated herein by reference.

PRIORITY CLAIM

This application is based on and claims the priority under 35 U.S.C. §119 of German Patent Application 198 24 613.7-26, filed on Jun. 2, 1998.

FIELD OF THE INVENTION

The invention relates to a method for monitoring the operation of electromagnets especially in a weft prewinder in a loom. Specifically, the release and stopping of the weft thread by a weft controller or by a weft brake takes place in the prewinder or downstream of the prewinder to be monitored.

BACKGROUND INFORMATION

The weft thread supply in modern rapidly operating air nozzle weaving looms is accomplished by so-called weft prewinders which provide weft thread sections of predetermined length in accordance with the weft insertion capacity of the loom. The released weft section length depends on the width of the fabric being woven. A released weft thread section is stopped at its tail end under the control or rather in response to the loom control that controls the weft insertion into the loom shed. Prior to the sequential release of weft thread sections, the weft thread is wound on the weft prewinder. The weft controller is arranged downstream of the prewinder, as viewed in the weft advance direction. The weft controller is a weft stopper functioning as a clamp controllable through an electromagnet to either stop or release the weft thread.

In the course of a weft thread insertion the loom control electrically controls the main weft insertion nozzle and the prewinder in synchronism with each other in such a way that the weft controller or stopper of the weft prewinder and the valve of the main nozzle are operated in synchronism for the release of the required weft length to be inserted into the loom shed by the nozzle. This synchronous control includes the electrical energizing of the electromagnetic control valve of the main weft insertion nozzle. The same synchronous control activates the weft stopper at the end of a weft thread insertion sequence. Thus, it is assured that the weft length released by the weft prewinder corresponds to the required weft thread insertion length. For this purpose the diameter of the prewinder drum is adjustable and the prewinder drum releases a whole number of turns the total length of which corresponds to the required weft thread insertion length for the fabric being woven. For these functions conventional weft prewinders are equipped with at least one weft stopper or weft controller which is radially positionable relative to the prewinder drum diameter for sequentially releasing the leading end of a weft thread or stopping the trailing end of the weft thread.

European Patent EP 0,544,730 (Josefsson et al.) discloses a method for controlling a weft thread supply and measuring device. Such a device includes at least one weft thread stop that is activated either directly by an electromagnet or indirectly in response to the switching of an electromagnetically operated valve of the main nozzle. As disclosed in the just mentioned European Patent, the synchronous operation of the electromagnetic stopper of the prewinder and the magnetic valve of the main nozzle of an air nozzle weaving loom requires as a precondition that the point of time when a weft thread is released, the point of time when a released weft thread must be stopped, and the operational times of the main nozzle must properly coincide with each other or these times must at least be within certain acceptable tolerance limits. The prior art does not monitor, whether these preconditions for the synchronous operation of the loom continue to exist once weaving has started and continues.

When the weft controller or stopper of the prewinder releases the stopped weft thread with a delay, for example the stopping phase is too long by a few milliseconds after the begin of the weft insertion by the main nozzle, the weft thread between the prewinder and the main nozzle is exposed to a relatively high tension force. Similarly, when the stopper releases the weft thread too early, proper weft tensioning may not be possible. The relatively high tension force caused by a delayed stopper release can lead to weft thread breaks, depending on the yarn characteristics, such as the tensile strength of the weft thread. The break may occur directly during the just mentioned relative short time delay or it may occur during the further complete insertion of the weft thread into the loom shed.

Without the proper monitoring of the points of time required for the above mentioned synchronization between the stopper function and the main weft insertion nozzle it is conventionally not possible to directly recognize the cause for a weft thread break.

Similarly, stopping the weft thread too late, namely at a point of time after the rated or control stopping point of time, also leads to production faults because now the weft thread section is too long and hence not properly tensioned. The weft section is tool long because the prewinder dispensed an additional length of weft thread corresponding to a full turn of the weft thread prewinder. Such additional length is unnecessary for the current weft insertion. Under this condition of delayed stopping, as opposed to delayed release, weft loops can be formed that appear as faults in the fabric, or that can also lead to weft thread breaks.

The above mentioned U.S. Pat. No. 5,787,937 (Teufel), relates to a method for monitoring the proper functioning of electromagnetic air valves by evaluating a characteristic dip or drop in the energizing current characteristic of the electromagnet that drives the valve which provides air for the main weft insertion nozzle. Such monitoring provides an early recognition of possible defects or failure in the electrically controllable electromagnet that operates the valve of the main weft insertion nozzle in a loom. The disclosure of the above U.S. Patent recognizes the fact that all electromagnetic systems including electromagnetically operated valves have a characteristic curve of their drive current I as a function of time t(I=f(t)). This drive or actuating current characteristic has a short duration current dip or current reduction after the switch-on point of time. This dip in the energizing current occurs when the driven magnetic valve actually, physically switches over following switching on of the power for energizing the valve drive electromagnet. The prior art does not recognize the general applicability of the above actuating current characteristic for control and synchronizing purposes.

OBJECTS OF THE INVENTION

In view of the above it is the aim of the invention to achieve the following objects singly or in combination:

- to generally monitor the actual beginning of operation of an electromagnetically driven device and comparing that actual time, which follows a switch-on time, with one or more rated points of time to ascertain or assure a proper operational synchronization between different electromagnetically operated components, particularly loom components;
- to monitor the actual switching times of a magnetically operated weft thread stopper that cooperates with or is part of a prewinder of a pneumatic loom for avoiding or correcting unpermissible deviations from rated operating times of magnetically operated components in such a loom; and
- to provide a basis for recognizing causes of weft insertion faults where these causes are based on a magnetic weft stopper operation that is either too early or too late relative to a rated weft stopper operation timing; and preferably also relative to operating times of other electromagnetically operated devices in a loom such as valves, cutters or the like.

SUMMARY OF THE INVENTION

The above objects are achieved generally by the present method for evaluating the operation of an electrically actuatable device operated by an electromagnet, except a magnetic valve for controlling an air flow to one or more weft insertion relay nozzles in a loom, said method comprising the following steps:

(a) applying an electrical actuation current ($I_1$) to said electromagnet to generate an energizing curve $I_1=f(t)$ of said electromagnet;

(b) monitoring electromagnetic energizing curve of said electrical actuation current ($I_1$) over time (t) for detecting an actual value of an electrical indicator that represents the beginning of an actually effective operation of said electromagnet;

(c) establishing a reference value for said electrical indicator;

(d) comparing said actual value of said electrical indicator with said reference value; and (e) releasing a fault signal if said actual value unacceptably deviates from said reference value.

The above mentioned electrical indicator may be selected from the group of a characteristic increasing curve representing said energizing curve $I_1=f(t)$, a time of occurrence of a characteristic feature within said increasing curve, or a magnitude of said characteristic feature. For example, a current dip in the energizing curve or a voltage fluctuation may be used for the present purposes. Such a current dip or voltage fluctuation signifies the fact that the electromagnet has started to effectively work for its intended puprose following switch-on of the actuation current $I_1$.

According to the invention there is further provided a specific method for monitoring the weft release function and/or the weft stop function of a weft thread supply controller having an electrically operated electromagnet and forming part of a weft thread prewinder in a weaving loom, wherein said weft thread supply controller permits the release of a whole number of weft thread windings from said weft prewinder for insertion into a shed of said weaving loom at predetermined points of time and wherein said weft thread supply controller intermittently stops the weft release, said method comprising the following steps:

(a) energizing said electromagnet by supplying an electrical actuation current ($I_1$) to said electromagnet to provide an energizing current curve ($I_1=f(t)$), said energizing producing an electrical characteristic indicator as part of said energizing current curve;

(b) measuring said electrical characteristic indicator generated by said energizing step;

(c) evaluating said electrical characteristic indicator for providing information at least regarding either the weft release function or regarding the weft stop function or both;

(d) energizing a second electromagnet for producing a second electrical characteristic indicator in a second energizing current curve ($I_2=f(t)$), (e) measuring said second electrical characteristic indicator, (f) evaluating said second electrical characteristic indicator for providing further information, (g) comparing said information with said further information to ascertain a required time relationship between said first and second electrical characteristic indicators, (h) providing a control signal when said required time relationship is not satisfied, and (i) stopping said loom in response to said control signal.

BRIEF DESCRIPTION OF THE DRAWINGS

In order that the invention may be clearly understood it will now be described in connection with example embodiments, with reference to the accompanying drawings, wherein:

FIG. 1 is a diagram showing a characteristic progression or curve of the actuation current I as a function of time t of an electromagnet for energizing any magnetically operated device such as the electromagnetically operated main valve or relay valves controlling the air supply for moving a weft thread through a loom shed;

FIG. 2 is a block circuit diagram of an evaluation circuit for detecting and evaluating measured values of time intervals and/or actuation current progression curves of an electromagnet by comparison with nominal values or with further measured values from another electromagnet according to the invention.

Figure 3:
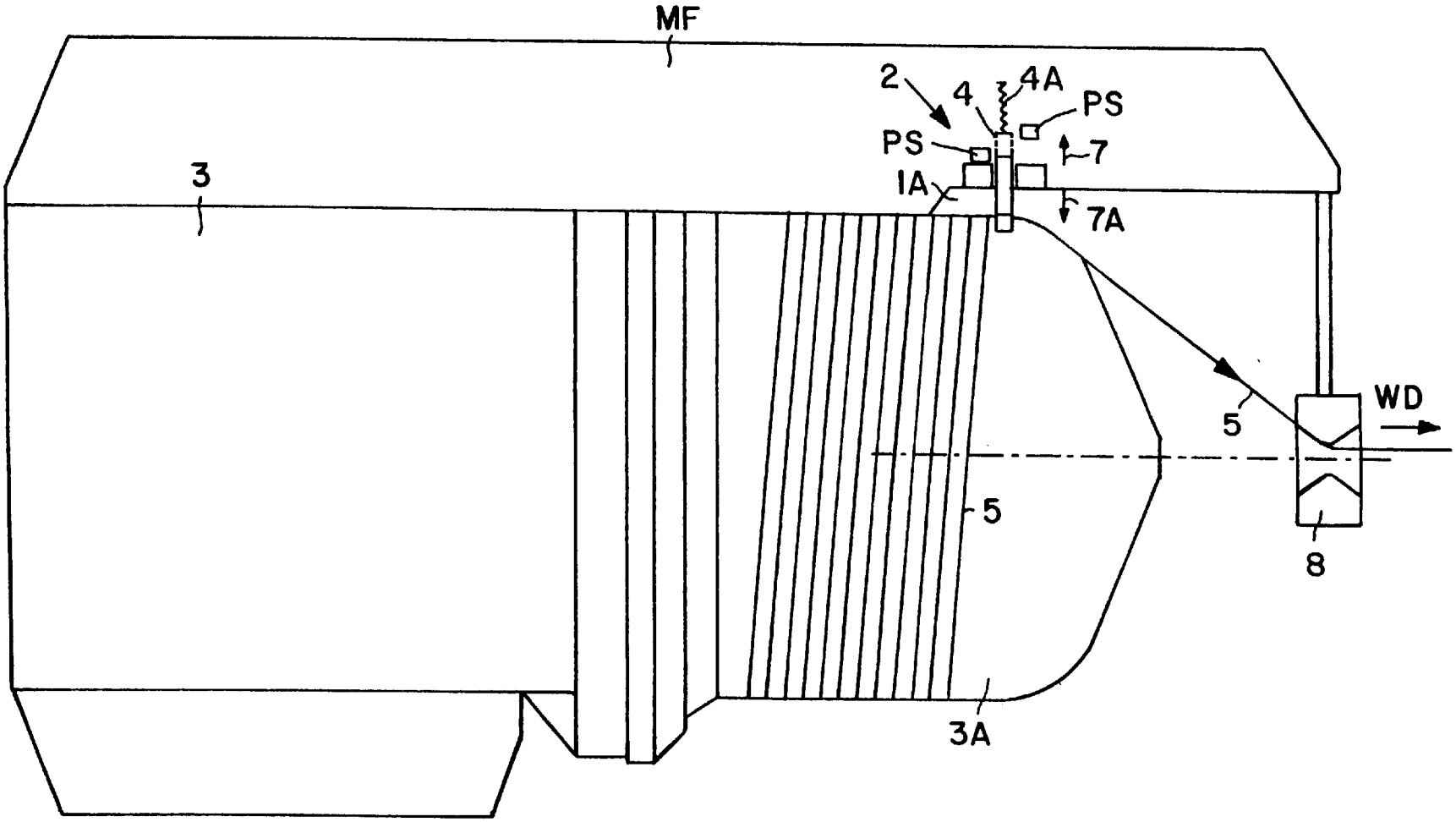
FIG. 3 is a schematic illustration of a weft prewinder with its weft controller shown in a weft stopping position under the force of a spring.

DETAILED DESCRIPTION OF PREFERRED EXAMPLE EMBODIMENTS AND OF THE BEST MODE OF THE INVENTION

FIG. 1 shows a rated energizing curve 1 of a first electromagnet 1A shown in FIG. 2. The first electromagnet 1A may drive any device 2 that can be operated by an electromagnet or solenoid except an air flow control valve. The device 2 is for example a weft controller 2 of a weft prewinder 3 shown in FIG. 3 for controlling the effective actuation period of a weft stopper 4 forming part of the weft controller 2.

The rated curve 1 of the energizing current $I_1$ referred to herein as energizing curve of the electromagnet is shown as a function of time (t) for the actuation of the controller 2 for controlling the weft supply by the prewinder 3 in a loom. In FIG. 1, the actuation or energizing current I, is shown on the ordinate axis or Y-axis and time t is shown on the abscissa or X-axis. The actuation current I, is provided by a direct current source VDC shown in FIG. 2 connected to the electromagnet 1A. When the direct current source VDC is switched on by a switch S at the time $t_{ON}$, the current will first rise rapidly along a characteristic curve portion A followed by a current dip 1' of very short duration, followed by a further relatively rapid rise portion B. During curve portions A and B of the energizing curve I, the current increases from zero up to the maximum or continuous current level at a plateau portion C during which the magnet energizing current is maintained at the maximum level for maintaining the electromagnet 1A in the actuated state. A decay curve portion D extends from the time at which the current is switched off until the current becomes zero.

The momentary current dip 1' occurs when an armature operated by the electromagnet 1A reaches an intended position, for example when the weft stopper 4 switches over from a weft stopping state to a weft release state. Thus, the current dip 1' will occur when the current level (or alternatively the voltage level) has increased to the point necessary for triggering the actuation of an armature by the particular electromagnet, which is expected to occur at a nominal or rated time t1 after the actuation current is switched on or initiated, for a properly functioning weft stopper 4 or a magnetic valve and valve actuation circuit.

According to the invention, the information provided by the current curve 1, and especially the characteristic current or energizing dip 1' between the two rising portions A and B of the curve 1, is used as an indication for the proper mechanical functioning of the electromagnet 1A and its armature 4 forming the weft controller 2. The current dip 1' is evaluated as an electrical indicator for the proper or improper functioning of the weft supply and weft insertion system of the pneumatic loom. More specifically, either the entire rising portions A and B of the curve 1, or the relative time of occurrence and/or the magnitude of the characteristic feature of the energizing curve 1, is monitored in order to detect any deviation of the actual data from corresponding reference data, which may be based on a nominal data input by the user or on previously measured data that have been stored in a memory. For example, based on empirical measured values a particular type of electromagnet will have its current dip 1' at a rated time t1. That information is stored as a reference value.

For example, if the characteristic feature such as the current dip 1' is completely missing from the rising curve portions A; B of the energizing curve 1, this is taken as an indication that the device operated by the electromagnet such as the armature forming the weft stopper 4 is not properly mechanically functioning, i.e. has failed to mechanically switch from the weft stopping position to the weft release position. Moreover, if the actually measured time t2 at which the characteristic feature 2' occurs between the actual energizing curve portions A', B' deviates to an unacceptable degree from the nominal or rated time t1 at which the characteristic feature should occur, or if the magnitude of the characteristic feature is unacceptably large or small, this would also indicate an improper functioning of the electromagnet 1A and its armature 4. Note that the time deviation relative to the occurrence of dip 1'. If $\Delta t=t_2-t_1$ (dip 2' occurs late as shown. $\Delta t=t_1-t_2$, dip 2' occurs early or prior to the rated dip 1. The occurrence of the characteristic feature, for example in the form of a current dip, could be measured relative to the previously occurring characteristic feature, i.e. in a previous actuation cycle of the electromagnet 1A.

FIG. 2 is a block diagram of a circuit 10 that can be used according to the invention for monitoring and evaluating the above discussed electrical indicators such as the current dip 1', 2'. A measuring circuit 11 monitors the magnet engerizing curve 1 of the current (or alternatively the voltage) of the actuation current I applied to the electromagnet 1A driving the weft controller 2. The specific components and construction of the measuring circuit 11 can be implemented in several different ways, as would be readily apparent to a person of ordinary skill in the art. The measuring circuit 11 may, for example, include appropriate current and/or voltage measuring circuits, filters, as well as a peak value detector to monitor the current and voltage values in the actuation or energizing circuit 12 for the electromagnet lA, and especially to detect and quantify the occurrence of the characteristic current dip 2' in the rising portion A', B' of the actually measured current curve. Namely, the measuring circuit 11 may quantify the actual measured time of occurrence of the characteristic current dip 2' relative to the start time $t_{ON}$ at which the current was switched-on by a switch S, and may quantify the magnitude of the current dip 2'. Alternatively, or as a further option, the measuring circuit 11 may monitor and analyze the entire rising portion A', B' of the actually measured curve. The specific components of the measuring circuit 11 may even be components or a circuit already present in the usual control circuitry for a pneumatic loom.

The measured data output of the measuring circuit 11 is then input into a data storage and evaluation circuit 13. The circuit 13 includes a temporary memory or receiver 14 for the measured value such as t2, and a memory or receiver 15 for a reference value such as t1. The input into the reference value receiver 15 is either a nominal value from a reference source 16 that is an external input by the operator of the loom, or the reference input may be previously measured data that were measured by the measuring circuit 11 during a prior actuation cycle of the electromagnet 1A and stored through a conductor 17 in the reference memory. The data storage and evaluation circuit 13 further includes a comparator 18 connected to the outputs of the measured value receiver 14 and the reference value receiver or memory 15. The comparator 18 compares the measured value, e.g. t2 with the reference value, e.g. t1 and provides an output signal 19, which is based on the difference between the measured value and the reference value, to the loom control 20.

As discussed above, the measured value may be an actual measured time t2 at which the actual characteristic current dip 2' occurs, while the reference value is a nominal value for the time of occurrence t1 of the current dip 1' or a previously measured time value. Alternatively, the measured value may be or may include an actual magnitude of the current dip 2', and the reference value may be a corresponding reference magnitude of the current dip 1'. As a further alternative, the measured value may be data characterizing the entire increasing portion A', B' of the actual current curve, while the reference value may be a corresponding reference plot of the increasing portion A, B of the rated or nominal current curve 1.

FIG. 2 further shows a second measuring circuit 21 alternatively connected with its measured value output 21' to the input of the reference memory 15 for providing data from a second electromagnet 22 driving, for example, an electromagnetic valve 23. The magnet 22 is energized in a circuit 24 as has been described above for the magnet 1A. The comparing of the measured signal at the output 21' from the second measuring circuit 21 with the measured signal at the output 11' of the first measuring circuit 11 provides information for synchronizing the operation of the valve drive magnet 22 with the operation of the weft controller drive magnet 1A in a loom.

If the data storage and evaluation circuit 13 detects a complete absence of the characteristic current dip 2' in the measured value, or detects a time t2 deviation of the occurrence of the characteristic current dip 2' from the nominal or reference time t1, outside of an acceptable tolerance range then the circuit 13 provides an output signal 19 that indicates a fault in the operation in the corresponding electromagnet 1A and the weft controller 2. This fault signal is used in the loom control 20 to adjust and correct the operation of the respective electromagnet 1A or to interrupt the weaving process.

FIG. 3 shows a weft prewinder 3 including a housing MF of a loom not shown. The prewinder 3 cooperates with the above mentioned weft thread controller 2 driven by the electromagnet or solenoid 1A having an armature 4 forming the above mentioned weft stopper biased by a spring 4A. When the solenoid 1A is energized it pulls the armature 4 up out of contact with the weft thread 5, thereby releasing the weft thread 5 for withdrawal from the drum 3A of the weft prewinder 3 in the withdrawal direction WD through a weft guide 8 leading the weft thread to the main weft insertion nozzle of the loom, not shown. The main weft insertion nozzle receives its air from the valve 23 driven by the magnet 22 shown in FIG. 2.

When the armature 4 is lifted by its electromagnet 1A as indicated by the arrow 7 the spring is compressed, thereby storing energy for subsequently pressing the armature 4 down as indicated by the arrow 7A against the drum 3A, thereby stopping the weft thread 5 against further withdrawal. This stopping of weft thread 5 takes place when the energizing current for the the electromagnet 1A is switched off, whereby the spring 4 expands.

Position sensors PS are so located relative to the movement path of the armature 4 that end positions of the armature provide respective signals by the sensors PS. These signals are then evaluated in the loom control 20 for indicating that the weft thread is stopped or released. These position signals may also be used for control purposes, e.g. the stop position signal may be used for controlling the renewed energizing of the electromagnet lA, for the next weft release. The release position signal may be used for controlling the switching off the power to the electromagnet 1A to cause the next stop phase by the force of the spring 4A.

Instead of using a spring biasing force for causing the weft stopping action of the armature 4, a double acting electromagnet may be used. For example, the magnet may have two windings or the energizing voltage may be reversed for moving the armature in one or the other direction.

Incidentally, the switch-on time $t_{ON}$ may be controlled by the fault signal for restoring the coincidence between t1 and t2 or for at least keeping these electrical characteristic indicator values in a permissible tolerance range.

In an embodiment as shown in FIG. 2, the operation of the valve 23 that supplies air to the main weft insertion nozzle of the loom, and the operation of the weft controller 2 with its stopper armature 4 are synchronized with each other by comparing the measurements from the circuits 11 and 21 and generating respective control signals that control the energization timing of the electromagnets 1A and 22 through the central loom control 20. In this manner excessive stretching and two much slack in the supplied weft thread length are avoided.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method for evaluating the operation of an electrically actuatable device operated by an electromagnet, except a valve operated by an electromagnet for controlling an air flow to one or more weft insertion nozzles in a loom, said method comprising the following steps:

(a) energizing said electromagnet by applying an electrical actuation current ($I_1$) to said electromagnet, said actuation current forming an energizing curve ($I_1$=f(t));

(b) monitoring said energizing curve over time (t) for detecting an actual value of an electrical indicator that represents the beginning of an actually effective operation of said electromagnet;

(c) establishing a reference value for said electrical indicator;

(d) comparing said actual value of said electrical indicator with said reference value;

(e) generating a fault signal if said actual value of said electrical indicator unacceptably deviates from said reference value, wherein said fault signal is an advance warning of expected future electromagnet failure when a difference between said actual value and said reference value exceeds a lower first threshold and does not exceed a higher second threshold, and wherein said electromagnet fault message is an indication of an actual, present electromagnet failure when said difference exceeds said higher second threshold.

2. The method of claim 1, further comprising a step of establishing a tolerance range of an acceptable deviation of said actual value from said reference value, and wherein said releasing step (e) comprises releasing said fault signal if a difference between actual value and said reference value falls outside of said tolerance range.

3. The method of claim 1, wherein said reference value is an inputtable rated value for the operation of said electromagnet, and said step (c) of establishing said reference value comprises inputting said rated value into a reference value memory.

4. The method of claim 1, further comprising repeatedly carrying out said step (a) to provide electromagnet actuation cycles in succession, wherein said reference value is a prior actual value from a prior electromagnet actuation cycle, and wherein said step (c) comprises at least temporarily storing said prior actual value into a reference value memory.

5. The method of claim 1, wherein said electrical indicator is an increasing characteristic of said energizing curve, said step (b) comprises monitoring and detecting measured data corresponding to said increasing characteristic of said energizing curve as a function of time beginning at a time of switching-on said electrical actuation current, and wherein said reference value comprises reference data corresponding to an increasing reference curve as a function of time.

6. The method of claim 5, wherein said step (d) comprises determining an amount of time-shift between said measured data and said reference data, and said step (e) comprises releasing said fault signal if said amount of time-shift is outside an acceptable tolerance range.

7. The method of claim 1, wherein said electrical indicator is selected from the group consisting of at least one characteristic increasing curve, a time of occurrence of a characteristic feature within said increasing curve, and a magnitude of said characteristic feature, and wherein said time of occurrence of said characteristic feature or said magnitude of said character feature is compared with a reference time or a reference magnitude of said characteristic feature.

8. The method of claim 7, wherein said at least one characteristic increasing curve comprises a momentary current dip in said characteristic increasing curve of said electrical actuation current that energizes said electromagnet.

9. The method of claim 7, wherein said characteristic feature comprises a momentary voltage fluctuation in said at least one characteristic increasing curve of said electrical actuation current that energizes said electromagnet.

10. The method of claim 7, wherein said electrical indicator is said time of occurrence of said characteristic feature, wherein said reference value comprises said reference time, and said step (e) comprises releasing said fault signal if said time of occurrence of said characteristic feature deviates from said reference time outside an acceptable tolerance time range.

11. The method of claim 7, wherein said electrical indicator is said magnitude of said characteristic feature, said reference value comprises said reference magnitude, and said step (e) comprises releasing said fault signal if said magnitude of said characteristic feature deviates from said reference magnitude outside an acceptable magnitude tolerance range.

12. The method of claim 7, wherein said actual value detected in said step b) is a nil value, and wherein said steps (d and e) comprise releasing said fault signal in response to said nil value.

13. The method of clam 1, further comprising displaying an electromagnet fault message in response to release of said fault signal.

14. The method of claim 1, wherein said actual value is an actual time value, said reference value is a reference time value, and said step (d) comprises determining a time deviation of said actual time value from said reference time value, and further comprising adjusting a time of initiating said step (a) in a subsequent electromagnet actuation cycle dependent upon said time deviation of said actual time value from said reference time value.

15. The method of claim 14, wherein said adjusting of said time of initiating said step (a) comprises time-shifting said time of initiating so as to reduce said time deviation of said actual time value from said reference value.

16. The method of claim 1, wherein said electromagnet is energized by said actuation current for operating a weft controller or weft brake in a pneumatic loom.

17. A method for monitoring a weft release function and a weft stop function of a weft thread supply controller having an electrically operated electromagnet and forming part of a weft thread prewinder in a weaving loom, wherein said weft thread supply controller permits the release of a whole number of weft thread windings from said weft prewinder for insertion into a shed of said weaving loom at predetermined points of time and wherein said weft thread supply controller intermittently stops the weft release, said method comprising the following steps:

(a) energizing said electromagnet by supplying an electrical actuation current ($I_1$) to said electromagnet to provide an energizing current curve ($I_1$=f(t)), said energizing producing an electrical characteristic indicator as part of said energizing current curve;

(b) measuring said electrical characteristic indicator generated by said energizing step;

(c) evaluating said electrical characteristic indicator for providing information at least regarding one of said weft release function and said weft stop function; and (d) energizing a second electromagnet for producing a second electrical characteristic indicator in a second energizing current curve ($I_2$=f(t)), (e) measuring said second electrical characteristic indicator, (f) evaluating said second electrical characteristic indicator for providing further information, (g) comparing said information with said further information to ascertain a required time relationship between said first and second electrical characteristic indicators, (h) providing a control signal when said required time relationship is not satisfied, and (i) stopping said loom in response to said control signal.

18. The method of claim 17, wherein said evaluating step comprises sensing the presence or absence of said electrical characteristic indicator and supplying a corresponding information to a central control of said weaving loom.

19. The method of claim 17, wherein said evaluating step comprises providing a time reference point, sensing a time shift of said electrical characteristic indicator relative to said time reference point, and supplying an information regarding said time shift to a central control of said weaving loom.

20. The method of claim 17, comprising establishing for said electromagnet a rated point of time Δt1 when said electromagnet performs its function following said energizing switching-on of said electromagnet, performing said measuring step to obtain information whether said electric characteristic indicator takes place at a second point of time (t2) differing from said rated point of time (t1) for providing an actual point of time (t2), wherein said evaluating step comprises comparing said actual point of time (t2) with said rated point of time (t1) for ascertaining a time difference between said actual value and said rated value.

21. The method of claim 20, further comprising measuring said actual value (t2) repeatedly, performing said comparing repeatedly for providing respective time difference informations and evaluating said time difference informations for providing a fault signal when said actual point of time (t2) differs from said rated point of time (t1) at least twice.

22. The method of claim 17, further comprising sensing with a position sensor an instantaneous position of a weft stopper of said weft supply controller moved by said electromagnet for performing said weft stop function to provide a stopper position signal and evaluating said stopper position signal to indicate whether said weft stop function is correctly performed.

23. The method of claim 22, wherein said electromagnet comprises an armature functioning as said weft stopper, said method further comprising pulling said weft stopper into a withdrawn position in response to said energizing of said electromagnet for releasing a weft length, and pressing said weft stopper into a projected position for urging said weft stopper against a weft thread by a spring force when said actuation current is switched off.

24. The method of claim 17, wherein said electromagnet comprises a double acting armature movable in one or in the opposite direction, said method further comprising first energizing said electromagnet for moving said double acting armature in said one direction and secondly energizing said electromagnet for moving said double acting armature in said opposite direction, whereby said first energizing provides one of said electrical characteristic indicator and said second energizing provides a second electrical characteristic indicator, and measuring and evaluating at least one of said first and second electrical characteristic indicators for providing said information.

25. The method of claim 24, wherein said first energizing moves said double acting armature in a weft release direction and wherein said second energizing moves said double acting armature in a weft stopping direction.

26. The method of claim 17, wherein said required time relationship is a coincidence between said first and second electrical characteristic indicators.

27. The method of claim 17, wherein said required time relationship is satisfied if said first and second electrical characteristic indicators fall within a predetermined time interval.

28. The method of claim 17, wherein said required time relationship is determined by a rotational angle of a main drive shaft of said loom.

29. A method for evaluating the operation of an electrically actuatable device operated by an electromagnet, except a valve operated by an electromagnet for controlling an air flow to one or more weft insertion nozzles in a loom, said method comprising the following steps:

(a) energizing said electromagnet by applying an electrical actuation current ($I_1$) to said electromagnet for operating a weft controller or weft brake in a pneumatic loom, said actuation current forming an energizing curve ($I_1$=f(t));

(b) monitoring over time (t) for detecting an actual value of an electrical indicator that represents the beginning of an actually effective operation of said electromagnet; for detecting an actual value of an electrical indicator that represents the beginning of an actual operation of said electromagnet;

(c) establishing a reference value for said electrical indicator;

(d) comparing said actual value of said electrical indicator with said reference value;

(e) generating a fault signal if said actual value unacceptably deviates from said reference value.

* * * * *

UNITED STATES PATENT AND TRADEMARK OFFICE
CERTIFICATE OF CORRECTION

PATENT NO. : 6,176,272

DATED : January 23, 2001

INVENTOR(S) : Wahhoud et al.

It is certified that error appears in the above-identified patent and that said Letters Patent is hereby corrected as shown below:

| | | |
|---|---|---|
| Col. 3, | line 55, | after "intended", replace "puprose" by --purpose--; |
| Col. 4, | line 66, | after "current", replace "1," by --$1_1$--; |
| Col. 5, | line 1, | after "current", replace "1," by --$1_1$--; |
| Col. 5, | line 8, | after "current", insert --$1_1$--; |
| Col. 5, | line 26, | before "curve", insert --or energizing--; |
| Col. 5, | line 27, | before "dip", delete --or energizing--; |
| Col. 5, | line 46, | after "portions A", replace ";" by --and--; |
| Col. 5, | line 59, | after "deviation", insert --$\Delta t$ could be late or early--; |
| Col. 5, | line 59, | before "dip", replace "(", by --then--; |
| Col. 5, | line 60, | after "shown.", insert --If--; |
| Col. 5, | line 60, | before "dip", insert --then--; |
| Col. 6, | line 2, | after "magnet", replace "engerizing" by --energizing--; |
| Col. 7, | line 32, | after "of", insert --the--; |
| Col. 8, | line 38, | after "between", insert --said--; |
| Col. 9, | line 32, | before "said", delete --release of--. |

Signed and Sealed this

Fifteenth Day of May, 2001

*Attest:*

Nicholas P. Godici

NICHOLAS P. GODICI

*Attesting Officer*

*Acting Director of the United States Patent and Trademark Office*